US008976076B2

(12) United States Patent
Yoshida et al.

(10) Patent No.: US 8,976,076 B2
(45) Date of Patent: Mar. 10, 2015

(54) HIGH-FREQUENCY TRANSMISSION LINE, ANTENNA, AND ELECTRONIC CIRCUIT BOARD

(71) Applicant: TDK Corporation, Tokyo (JP)

(72) Inventors: Kenichi Yoshida, Tokyo (JP); Yuhei Horikawa, Tokyo (JP)

(73) Assignee: TDK Corporation, Tokyo (JP)

( * ) Notice: Subject to any disclaimer, the term of this patent is extended or adjusted under 35 U.S.C. 154(b) by 222 days.

(21) Appl. No.: 13/790,803

(22) Filed: Mar. 8, 2013

(65) Prior Publication Data

US 2013/0257682 A1 Oct. 3, 2013

(30) Foreign Application Priority Data

Mar. 30, 2012 (JP) ..... 2012-082489
Jan. 16, 2013 (JP) ..... 2013-005509

(51) Int. Cl.

*H01Q 1/36* (2006.01)
*H01P 3/08* (2006.01)
*H01Q 1/50* (2006.01)
*H01P 11/00* (2006.01)

(52) U.S. Cl.

CPC .. *H01P 3/08* (2013.01); *H01Q 1/50* (2013.01); *H01P 11/003* (2013.01); *H01Q 1/36* (2013.01)
USPC ..... 343/905; 343/700 MS

(58) Field of Classification Search

CPC ..... H01Q 1/50; H01Q 1/36; H01P 3/08; H01P 11/003
USPC ..... 343/905, 702, 731, 700 MS; 333/238
See application file for complete search history.

(56) References Cited

U.S. PATENT DOCUMENTS

2011/0285215 A1* 11/2011 Hatase ..... 307/104
2013/0057452 A1* 3/2013 Watanabe ..... 343/905
2013/0088406 A1* 4/2013 Hamada et al. ..... 343/893
2014/0266532 A1* 9/2014 Yamada ..... 336/175

FOREIGN PATENT DOCUMENTS

JP A-2001-15878 1/2001

* cited by examiner

*Primary Examiner* — Hoanganh Le
(74) *Attorney, Agent, or Firm* — Oliff PLC

(57) ABSTRACT

A high-frequency transmission line having low alternate current (AC) resistance is provided. One aspect of the present invention is a high-frequency transmission line disposed along a surface of an insulating support, wherein, letting F [Hz] be the frequency of an AC electric signal transmitted by the high-frequency transmission line and Ms [Wb/m] be the saturation magnetization per unit area, the frequency value F and the saturation magnification value per unit area Ms satisfy the following expression (1):

$$Ms \leq (1.5\times10^{2})/F+5.7\times10^{-8} \quad (1).$$

14 Claims, 7 Drawing Sheets

(a)

(b)

(a)

(b)

(a)

(b)

(a)

(b)

HIGH-FREQUENCY TRANSMISSION LINE, ANTENNA, AND ELECTRONIC CIRCUIT BOARD

TECHNICAL FIELD

The present invention relates to a high-frequency transmission line, an antenna (radiation and absorption conductors), and an electronic circuit board.

BACKGROUND

Electronic components are provided with transmission lines for transmitting electric signals. With the advent of highly advanced information in recent years, alternate current (AC) electric signals transmitted by transmission lines have been shifting their frequency bands to higher frequency bands. For example, communication frequency bands in mobile information terminals range from several hundreds of MHz to several GHz. A skin effect occurs in a high-frequency transmission line which transmits AC electric signals in such a high frequency band. In the skin effect, the current density of the high-frequency signal flowing through the transmission line is higher on a surface of the transmission line and becomes lower as farther away from the surface. As the frequency of the AC electric signal is higher, the current concentrates more on the transmission line surface, whereby the AC resistance increases in the transmission line. Hence, for lowering the AC resistance in the high-frequency transmission line, it is required to attain higher electrical conductivity on the transmission line surface.

As an example of methods for lowering the AC resistance in a high-frequency transmission line, the following Patent Literature 1 discloses a high-frequency wiring board in which the surface roughness (arithmetic mean roughness Ra) at an interface between a high-frequency wiring layer (transmission line) and a dielectric substrate is 0.3 μm or less. This high-frequency wiring board suppresses irregularities on a surface of the high-frequency wiring layer in contact with the dielectric substrate, so as to reduce reactivity at the interface and decrease the length of the transmission line, thereby lowering transmission loss.

Patent Literature 1: Japanese Patent Application Laid-Open No. 2001-015878

SUMMARY

In the technique disclosed in the above-mentioned Patent Literature 1, however, the area of the interface between the transmission line and the dielectric substrate is so small that the transmission line may fail to come into sufficiently close contact with the dielectric substrate and be likely to peel off therefrom.

As also disclosed in the above-mentioned Patent Literature 1, high electrical conductivity is required for transmission lines, whereby copper and copper-based alloys are widely in use as base materials (conductor layers) for the transmission lines. However, copper and copper alloys are likely to be deteriorated by oxygen in the air, water, and corrosive gases. Therefore, the high-frequency wiring layer described in the above-mentioned Patent Literature 1 may fail to have a sufficient resistance to corrosion. For protecting conductor layers against rust, moisture, and corrosion, it has been studied to coat surfaces of the conductor layers with films plated with nickel, gold, and the like. However, the inventors have found that transmission loss increases when conductor layers are coated with the conventionally known nickel plating.

The inventors have also found that the technique disclosed in the above-mentioned Patent Literature 1 is effective in lowering the transmission loss when the AC electric signal has a frequency of 10 GHz or higher but does not always achieve the effect of lowering the transmission loss when the frequency of the AC electric signal is lower than 10 GHz.

In view of the circumstances mentioned above, it is an object of the present invention to provide a high-frequency transmission line having low AC resistance and an antenna (radiation and absorption conductors) and an electronic circuit which are equipped with the high-frequency transmission line.

One aspect of the high-frequency transmission line in accordance with the present invention is a high-frequency transmission line disposed along a surface of an insulating support, wherein, letting F [Hz] be the frequency of an alternate current (AC) electric signal transmitted by the high-frequency transmission line and Ms [Wb/m] be the saturation magnetization per unit area (areal saturation magnetization) of the high-frequency transmission line, the frequency value F and the areal saturation magnification value Ms satisfy the following expression (1). While F in the following expression (1) is in the unit of Hz, values of frequencies such as F may be noted in the unit of MHz or GHz for convenience. Hz, MHz, and GHz vary in their digit notations but have the same meaning.

$$Ms \leq (1.5\times10^{2})/F+5.7\times10^{-8}. \quad (1)$$

Preferably, one aspect of the high-frequency transmission line in accordance with the present invention comprises a conductor layer disposed on the surface of the insulating support and a coating layer covering a surface of the conductor layer.

Preferably, in one aspect of the high-frequency transmission line in accordance with the present invention, the coating layer contains at least one of nickel and palladium.

Preferably, in one aspect of the high-frequency transmission line in accordance with the present invention, the coating layer contains nickel, the coating layer is formed by electroless plating, and a plating solution used for the electroless plating contains at least one complexing agent selected from the group consisting of carboxylic acids, dicarboxylic acids, hydroxy acids, and amino acids and elemental nickel.

In one aspect of the high-frequency transmission line in accordance with the present invention, the coating layer may contain elemental phosphorus.

In one aspect of the high-frequency transmission line in accordance with the present invention, the plating solution may contain elemental phosphorus.

One aspect of the antenna (radiation and absorption conductors) in accordance with the present invention comprises the above-mentioned high-frequency transmission line.

One aspect of the electronic circuit board in accordance with the present invention comprises the above-mentioned high-frequency transmission line.

The present invention can provide a high-frequency transmission line having low AC resistance and an antenna (radiation and absorption conductors) and an electronic circuit which are equipped with the high-frequency transmission line.

BRIEF DESCRIPTION OF THE DRAWINGS

FIG. 1*a* is a schematic view of a surface of the high-frequency transmission line in accordance with an embodiment of the present invention, while FIG. 1*b* is a schematic view of a part of a cross section of the high-frequency transmission line of FIG. 1*a* perpendicular to the surface;

FIG. 5*a* is a chart illustrating relationships between the frequency F of AC electric signals transmitted by high-frequency transmission lines (Samples 10 to 12) and the AC resistance Rs of the high-frequency transmission lines, while FIG. 5*b* is a photograph of a cross section of the high-frequency transmission line of Sample 11 perpendicular to its insulating substrate;

FIG. 6*a* is a chart illustrating relationships between the frequency F of AC electric signals transmitted by high-frequency transmission lines (Samples 1, 7, and 9) and the AC resistance Rs of the high-frequency transmission lines, while FIG. 6*b* is a photograph of a cross section of the high-frequency transmission line of Sample 7 perpendicular to its insulating substrate; and FIG. 7*a* is a schematic view of a surface of an antenna device in accordance with an example of the present invention, while FIG. 7*b* is a schematic view of a part of a cross section, perpendicular to the surface, of a high-frequency transmission line provided with the antenna device of FIG. 7*a*.

DETAILED DESCRIPTION

Figure 1:
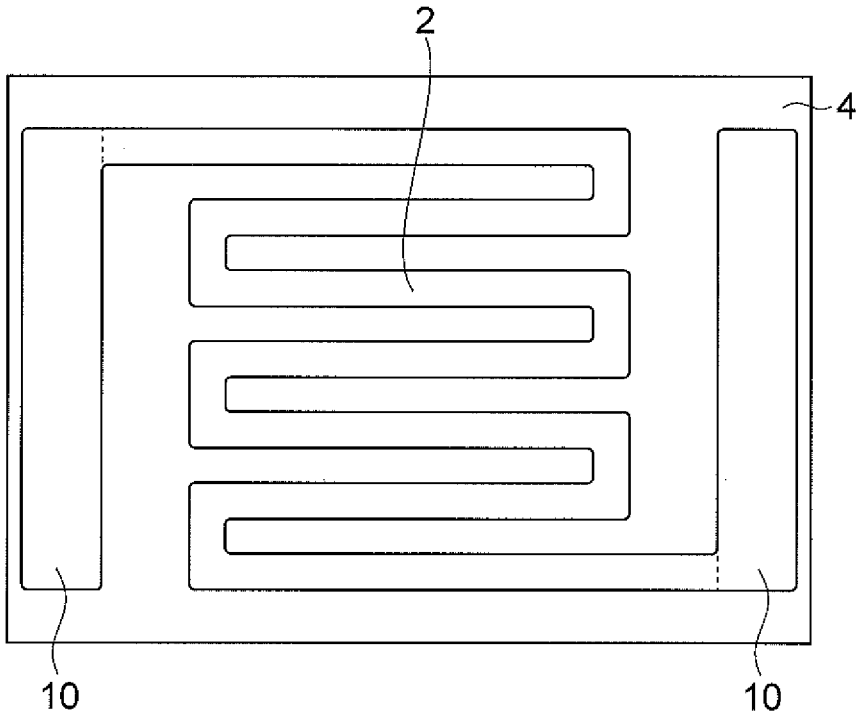
Figure 1:
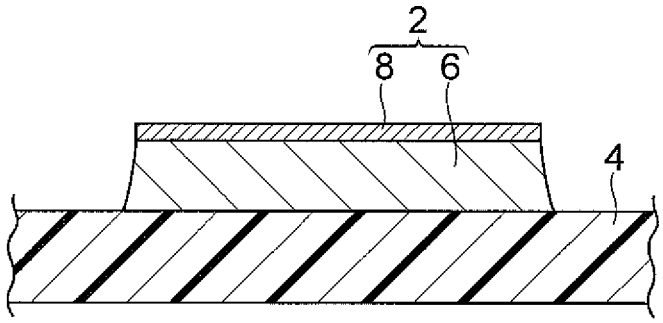

In the following, preferred embodiments of the present invention will be explained with reference to the drawings when necessary. However, the present invention is not limited to the following embodiments at all. In the drawings, the same or equivalent constituents will be referred to with the same signs while omitting their overlapping explanations.

As illustrated in FIGS. 1*a* and 1*b*, a high-frequency transmission line 2 in accordance with an embodiment is disposed along a surface of an insulating support 4. Terminals 10 are electrically connected to both end parts of the high-frequency transmission line 2, respectively. The high-frequency transmission line 2 is in the form of a meander pattern and functions as an antenna (radiation and absorption conductors).

Preferably, the high-frequency transmission line 2 comprises a conductor layer 6 disposed on the surface of the insulating support 4 (insulating substrate) and a coating layer 8 covering a surface of the conductor layer 6. The coating layer 8 protects the conductor layer 6 and thus can inhibit oxygen in the air, water, and corrosive gases from worsening the conductor layer 6. For securely restraining the conductor layer 6 from deteriorating, it is preferred for the whole surface of the conductor layer 6 to be covered with the coating layer 8. For lowering the contact resistance of the outermost layer (coating layer 8) of the high-frequency transmission line 2 and providing the outermost layer with solder wettability, an additional layer containing tin, palladium, gold, silver, or the like may further be provided on the outermost surface of the high-frequency transmission line 2.

Letting F [Hz] be the frequency of an AC electric signal transmitted by the high-frequency transmission line 2 and Ms [Wb/m] be the areal saturation magnetization of the high-frequency transmission line 2, the frequency value F and the areal saturation magnification value Ms satisfy the following expression (1):

$$Ms \leq (1.5\times10^{2})/F+5.7\times10^{-8}. \quad (1)$$

The areal saturation magnetization Ms [Wb/m] of the high-frequency transmission line 2 is computed by dividing the saturation magnetization (total saturation magnetization) [unit: Wb·m] in the high-frequency transmission line 2 and insulating support 4 in total by the total surface area [unit: $m^2$] of the high-frequency transmission line 2. Since the insulating support 4 has no magnetism, the total saturation magnetization and the saturation magnetization of the high-frequency transmission line 2 per se have substantially the same meaning. The surface area of the high-frequency transmission line 2 is the area of a surface of the high-frequency transmission line 2 parallel to a direction of an AC electric signal (current) propagating through the high-frequency transmission line 2. In other words, the surface area of the high-frequency transmission line 2 is the area of its surface substantially parallel to the surface of the insulating support 4. Though a current flows in a thickness direction of the high-frequency transmission line 2 (the stacking direction of the conductor layer 6 and coating layer 8) when a solder joint is formed on the surface of the high-frequency transmission line 2, the thickness direction of the transmission line 2 is not included in the "direction of an AC electric signal (current)" mentioned above.

In general, because of the skin effect, the AC resistance of the high-frequency transmission line 2 increases as the frequency F of the AC electric signal is higher. Covering the surface of the conductor layer 6 with the coating layer 8 allows the AC resistance of the high-frequency transmission line 2 to increase remarkably. The increase in AC resistance becomes more remarkable when the coating layer 8 is a magnetic body such as nickel plating in particular. However, since the frequency value F and the areal saturation magnetization value Ms satisfy the above-mentioned expression (1), this embodiment makes it possible to inhibit covering the conductor layer 6 with the coating layer 8 from increasing the AC resistance. That is, by appropriately adjusting the composition, thickness, or the like of the high-frequency transmission line 2 (coating layer 8 in particular) according to the frequency F of a designed AC electric signal in the high-frequency transmission line 2, this embodiment regulates the areal saturation magnification Ms so as to make it $(1.5\times10^{2})/F+5.7\times10^{-8}$ or below. This lowers the AC resistance, thereby reducing the transmission loss of the AC electric signal. By the same reason, an antenna device equipped with the high-frequency transmission line 2 in accordance with this embodiment inhibits covering the conductor layer 6 with the coating layer 8 from lowering the radiation efficiency and absorption efficiency. The radiation efficiency is defined as the ratio of the total electric power radiated by the antenna device to the total electric power supplied to the antenna device, for example. The absorption efficiency is defined as the ratio of the total electric power absorbed by the antenna device to the total electric power irradiated to the antenna device, for example. In a high-frequency transmission line in which Ms is greater than $(1.5\times10^{2})/F+5.7\times10^{-8}$, the AC electric signal concentrates on the surface (coating layer 8) of the high-frequency transmission line because of the skin effect, thereby remarkably increasing the AC resistance. The above-mentioned expression (1) is an empirical formula found for the first time by the inventors as a result of studies, and a method of theoretically deriving it is not always clear.

When the coating layer 8 is a magnetic body of nickel plating or the like in particular, controlling a magnetic characteristic of the coating layer 8 by adjusting the composition or thickness thereof can lower the areal saturation magnetization Ms and reduce the AC resistance. When the coating layer 8 is an electroless nickel plating layer containing phosphorus while the conductor layer 6 is made of copper, for example, satisfying the above-mentioned expression (1) reduces the AC resistance of the high-frequency transmission line 2 to a value which is 1.2 times or less of the AC resistance of a transmission line made of the conductor layer 6 alone (a high-frequency transmission line without the coating layer 8).

The value of areal saturation magnetization Ms is on the order of $1.0\times10^{-7}$ to $1.0\times10^{-6}$, for example. The value of areal saturation magnetization Ms is more preferred as it is smaller, while its lower limit is a value near the measurement limit for the areal saturation magnetization Ms. The upper limit for the areal saturation magnetization Ms corresponds to a value thereof in a case where the coating layer 8 is made of nickel alone.

The frequency F of the AC electric signal is preferably 100 MHz to 3.0 GHz, more preferably 200 MHz to 3.0 GHz. The method of lowering the AC resistance by reducing the surface roughness of the high-frequency transmission line 2 or the insulating support 4 can decrease the transmission loss within the frequency band on the order of 5.0 to 20 GHz but is hard to lessen the transmission loss sufficiently in a frequency band below 5.0 GHz. By contrast, this embodiment can lower the AC resistance and reduce the transmission loss of the AC electric signal even in the above-mentioned frequency band.

The inventors have found that the relationship represented by the above-mentioned expression (1) holding between the frequency value F and the areal saturation magnetization value Ms is not influenced by the surface roughness of the high-frequency transmission line 2 and insulating support 4. Therefore, unlike the technique described in the above-mentioned Patent Literature 1, this embodiment can lower the AC resistance without reducing irregularities in the interface between the high-frequency transmission line 2 and the insulating support 4. Hence, as compared with the technique described in the above-mentioned Patent Literature 1, this embodiment can increase the area of the interface between the high-frequency transmission line 2 and the insulating support 4 and bring the high-frequency transmission line 2 into sufficiently close contact with the insulating support 4.

As in the foregoing, this embodiment can totally inhibit the conductor layer 6 from deteriorating, the AC resistance from increasing, and the high-frequency transmission line 2 from peeling.

Examples of substances constituting the insulating support 4 include dielectric resin materials such as epoxy-resin-impregnated glass fiber, polycarbonate resins, ABS resins, and acrylic resins and dielectric inorganic materials such as glass ceramics. The average thickness of the insulating support 4, which is not limited in particular, is on the order of 50 μm to 2 mm. The width of the high-frequency transmission line 2, which is not limited in particular, is on the order of 10 μm to 30 mm.

Examples of compositions constituting the conductor layer 6 include copper, silver, gold, platinum, and palladium and alloys containing these elements. Preferred among them are copper and alloys containing copper, which have high electrical conductivity while being relatively inexpensive. The average thickness of the conductor layer 6, which is not limited in particular, is on the order of 5 to 50 μm.

For the areal saturation magnetization Ms satisfying the above-mentioned expression (1), it is preferred for the areal saturation magnetization Ms to be smaller. For reducing the areal saturation magnetization Ms, it is preferred for the coating layer 8 to have weaker magnetism. For lowering the AC resistance, it is preferred for the coating layer 8 to have higher electrical conductivity. For protecting the conductor layer 6, the coating layer 8 is required to have corrosion resistance and hardness (scratch resistance). Compositions constituting the coating layer 8 are not restricted in particular as long as they satisfy at least one of the conditions mentioned above. Specific examples of compositions constituting the coating layer 8 include nickel, zinc, tin, gold, silver, and palladium and alloys containing these elements. However, zinc, tin, gold, and silver are softer than the other metals. Nickel and palladium are preferred to the elements mentioned above in that they have corrosion resistance and scratch resistance. Nickel is more preferred in that it is relatively inexpensive. The average thickness of the coating layer 8, which is not restricted in particular, is on the order of 0.1 to 3.0 μm. The areal saturation magnetization Ms tends to decrease as the coating layer 8 is thinner, while the conductor layer 6 is more likely to be restrained from deteriorating as the coating layer 8 is thicker.

When formed by electroless nickel plating which will be explained later, the coating layer 8 contains not only metallic nickel, which is a main component, but inevitably phosphorus codeposited with nickel. In this case, the nickel content in the coating layer 8 is on the order of 83 to 99 mass % with respect to the whole coating layer 8. The phosphorus content in the coating layer 8 is on the order of 1 to 17 mass %. As the phosphorus content in the nickel plating layer is higher, the magnetism of the nickel plating layer tends to become weaker, thereby lowering Ms. As the phosphorus content in the nickel plating layer is lower, the hardness of the nickel plating layer tends to increase. The coating layer 8 may contain boron or sulfur in addition to nickel and phosphorus.

An example of methods for manufacturing the high-frequency transmission line of this embodiment will now be explained.

First, a commercially available insulating support 4 (insulating substrate) or an insulating support 4 produced by a known method is prepared. A conductor layer 6 in the form of a meander pattern is formed on a surface of the insulating support 4. For example, a resist is applied by a known method to a glass epoxy substrate (commercially available general-purpose product) having a copper foil layered thereon. Subsequently, the meander pattern is exposed to light and developed, copper is etched, and the resist is peeled off. These series of steps form the conductor layer 6 made of copper in the meander pattern along the surface of the insulating support 4. The conductor layer 6 in the meander pattern may also be transferred to or printed on the surface of the insulating support 4. In this case, the surface of the conductor layer 6 opposing the surface of the insulating support 4 or the surface of the insulating support 4 opposing the conductor layer 6 may be polished before the transfer or printing, so as to reduce the surface roughness of each surface. This can shorten the length of the completed transmission line, thereby lowering the transmission loss.

The surface of the conductor layer 6 formed on the insulating support 4 is degreased. Commercially available degreasing solutions may be used for degreasing. After dipping the conductor layer 6 in a degreasing solution, the surface of the conductor layer 6 may be washed with water. Preferably, an etchant such as sulfuric acid is used for etching the surface of the conductor layer 6.

After the etching, an activation step of dipping the conductor layer 6 in an activation solution is performed. As the activation solution, commercially available activation solutions may be used. After the activation step, a post-dip step of dipping the conductor layer 6 in a post-dip solution is performed. Of an activator (a palladium-based catalyst or the like) attached to the surface of the conductor layer 6 in the activation step, an excess is removed by the post-dip step. As the post-dip solution, commercially available post-dip solutions may be used.

After the post-dip step, a coating layer 8 is formed on a surface of the conductor layer 6. When forming the coating layer 8 mainly composed of metallic nickel, the conductor layer 6 is preferably formed by electroless nickel plating. That is, the conductor layer 6 is dipped in an electroless nickel plating solution (plating bath), so as to form a nickel plating layer on the surface of the conductor layer 6. The electroless nickel plating can easily control the composition, thickness, and the like of the coating layer 8.

Preferably, the electroless nickel plating solution is doped with a phosphorous compound such as a hypophosphite as a reductant. Adjusting the concentration of a phosphorus compound (e.g., sodium hypophosphite monohydrate) in the electroless nickel plating solution can regulate the phosphorous element content in the coating layer 8 (electroless nickel plating layer), thereby controlling the magnetism of the coating layer 8.

Preferably, the electroless nickel plating solution contains at least one complexing agent selected from the group consisting of carboxylic acids, dicarboxylic acids, hydroxy acids, amines, and amino acids. More preferably, the electroless nickel plating solution contains one or both of amino and dicarboxylic acids. This reduces the magnetism of the electroless nickel plating, whereby the high-frequency transmission line 2 whose areal saturation magnetization Ms is $(1.5\times10^{2})/F+5.7\times10^{-8}$ or less can be formed securely. The complexing agent content may be on the order of 10 to 100 g/L with respect to the total amount of the nickel plating solution. When the complexing agent content is too low, the electroless nickel plating solution tends to decrease its stability. When the complexing agent content is too high, the content of phosphorus codepositing on the coating layer 8 becomes unstable, thereby making it harder to control the magnetism of the coating layer 8.

The temperature (bath temperature) of the electroless nickel plating solution is on the order of 50 to 95° C., for example. When the bath temperature is too low, the deposition rate of electroless nickel plating may become extremely slow or the deposition may stop. When the bath temperature is too high, the concentration of the electroless nickel plating solution may fluctuate greatly because of water evaporation, thereby decreasing the stability in the resulting electroless nickel plating layer composition. The pH of the electroless nickel plating solution is adjusted to a value on the order of 4.0 to 7.0 with dilute sulfuric acid or ammonia, for example.

The foregoing steps complete the high-frequency transmission line 2 disposed along the surface of the insulating support 4.

While one aspect of the high-frequency transmission line functioning as an antenna (radiation and absorption conductors) is explained in the foregoing, the present invention is not limited to the above-mentioned embodiment at all. Other electronic circuit boards equipped with the above-mentioned high-frequency transmission line also achieve the same operations and effects as with the above-mentioned embodiment. For example, transistors, ICs, capacitors, inductors, filters, electromagnetic shields, and the like equipped with the above-mentioned high-frequency transmission line achieve the same operations and effects as with the above-mentioned embodiment. The coating layer may be constituted by nickel alone, nickel and palladium, or palladium alone. The coating layer containing palladium may be formed by a plating step using an electroless palladium plating solution.

EXAMPLES

The present invention will be explained in more detail with reference to Examples and Comparative Examples in the following but is not limited to the following Examples.

Sample 1

Step of Forming the Conductor Layer 6

A resist was applied by a known method to the whole surface of a copper foil layered on a glass epoxy substrate. Subsequently, a meander pattern was exposed to light and developed, copper was etched, and the resist was peeled off. These series of steps formed the meander pattern (conductor layer 6) made of copper and measurement terminals connected to both end parts thereof along the surface of the glass epoxy substrate (insulating support 4) (see FIGS. 1*a* and 1*b*). The glass epoxy substrate had a size of 4.5 mm (W)×3.2 mm (L)×0.8 mm (T). The meander pattern had a line width of 200 μm. The meander pattern had a line length of 19.7 mm. The meander pattern had an area S of 0.0394 $cm^2$. The meander pattern (conductor layer 6) made of copper had a thickness of 15 μm. The surface of the glass epoxy substrate had an arithmetic mean roughness Ra of 1.0 μm and a ten-point mean roughness Rz of 6.2 μm at its interface with the meander pattern.

Degreasing Step

The glass epoxy substrate formed with the meander pattern and measurement terminals was dipped for 3 min in a degreasing solution at 40° C. and then taken out and washed with water for 1 min. As the degreasing solution, Ace Clean 850 (product name) manufactured by Okuno Chemical Industries Co., Ltd. was used.

The degreased glass epoxy substrate was dipped for 1 min in an etchant at a temperature of 30° C., so as to etch the meander pattern surface. After the etching, the meander pattern was washed with water. Components of the etchant and their contents were adjusted as follows:

Sodium persulfate: 100 g/L

Sulfuric acid (98 mass %): 30 mL/L

Water: balance

Activation Step

After the etching, the glass epoxy substrate was dipped for 5 min in a plating activation solution at 35° C. Thereafter, the substrate was taken out of the plating activation solution and washed with water for 1 min. As the plating activation solution, NNP Accera (product name) manufactured by Okuno Chemical Industries Co., Ltd. was used.

Post-Dip Step

After the activation step, the glass epoxy substrate was dipped for 2 min in a post-dip solution at 25° C., so as to remove the excess of palladium components attached to the surface of the meander pattern (conductor layer 6). As the post-dip solution, NNP Post Dip 401 (product name) manufactured by Okuno Chemical Industries Co., Ltd. was used.

Electroless Nickel Plating Step

Water, nickel sulfate hexahydrate (nickel source), sodium hypophosphite monohydrate (reductant), carboxylic and hydroxy acids (complexing agents), a surfactant (lubricant), and a bismuth compound (stabilizer for the plating solution) were mixed, so as to prepare an electroless nickel plating solution. The pH of the electroless nickel plating solution was adjusted to 6.0 with an aqueous sodium hydroxide solution. The nickel source content in the plating solution was adjusted to 25 g/L. The reductant content in the plating solution was adjusted to 20 g/L. The stabilizer content in the plating solution was adjusted to 1 mg/L.

After the post-dip step, the glass epoxy substrate was dipped in the above-mentioned plating solution at 85° C., so as to form an electroless nickel plating solution (coating layer 8) having an average thickness of about 2 μm on the whole surface of the meander pattern (conductor layer 6). Thereafter, the glass epoxy substrate was taken out of the electroless nickel plating solution and washed with water for 1 min. The phosphorus concentration in the electroless nickel plating layer measured by an electron probe microanalyzer (EPMA) was 2.1 mass % with respect to the whole coating layer.

The foregoing steps yielded a high-frequency transmission line (Sample 1) in the meander pattern, disposed along the surface of the glass epoxy substrate (insulating support 4), comprising the conductor layer 6 made of copper and the electroless nickel plating layer (coating layer 8) covering the conductor layer 6 (see FIGS. 1*a* and 1*b*).

Samples 2 to 7

When making Samples 2 to 7, the pH, temperature, nickel source content, and reductant content in the electroless nickel plating solution were adjusted to values listed in Table 1. The complexing agents and stabilizers listed in Table 1 were used in Samples 2 to 7. The thickness of the coating layer 8 and the phosphorus (P) concentration therein in Samples 2 to 7 were adjusted to values listed in Table 1. Except for these items, the high-frequency transmission lines of Samples 2 to 7 were made by using the same method and materials as with Sample 1. The total of contents of complexing agents was adjusted as appropriate within a range from 10 to 100 g/L in the electroless nickel plating solutions used for making Samples 1 to 7.

Sample 8

When making Sample 8, a plating step using an electroless tin plating solution was performed while omitting all the steps from the activation step to the electroless nickel plating step. That is, when making Sample 8, the conductor layer 6 was covered with an electroless tin plating layer (coating layer 8) instead of the electroless nickel plating layer. The electroless tin plating solution was prepared by mixing water, tin methanesulfonate, methanesulfonic acid, thiourea, and various additives. The tin methanesulfonate content in the electroless tin plating solution was adjusted to 30 g/L. The methanesulfonic acid content in the electroless tin plating solution was adjusted to 100 g/L. The thiourea content in the electroless tin plating solution was adjusted to 70 g/L. The pH of the electroless tin plating solution was adjusted to 1.5. The temperature of the electroless tin plating solution was adjusted to 30° C. In the plating step, the glass epoxy substrate was dipped for 30 min in the electroless tin plating solution. The thickness of the electroless tin plating layer in Sample 8 was adjusted to 1 μm. Except for these items, the high-frequency transmission line of Sample 8 was made by using the same method and materials as with Sample 1.

Sample 9

Sample 9 free of the coating layer 8 was made by using the same method and materials as with Sample 1 except for lacking the series of steps from the degreasing step to the electroless nickel plating step. That is, Sample 9 is a meander pattern (high-frequency transmission line) made of copper (Cu) alone disposed along the surface of the glass epoxy substrate (insulating support 4).

Sample 13

When making Sample 13, a plating step using an electroless palladium plating solution was performed in place of the electroless nickel plating step. That is, when making Sample 13, the conductor layer 6 was covered with an electroless palladium plating layer (coating layer 8) instead of the electroless nickel plating layer. The electroless palladium plating solution was prepared by mixing water, a palladium salt (1 g/L), sodium hypophosphite monohydrate (1 g/L), ethylenediamine (15 g/L), and various additives. The pH of the electroless palladium plating solution was adjusted to 6.0. In the electroless palladium plating step, the glass epoxy substrate after the post-dip step was dipped for 20 min in the electroless palladium plating solution. In the electroless palladium plating step, the temperature of the electroless palladium plating solution was adjusted to 60° C. The thickness of the electroless palladium plating solution in Sample 13 was adjusted to 0.1 μm. Except for the foregoing items, the high-frequency transmission line of Sample 13 was made by using the same method and materials as with Sample 1.

Evaluation of Magnetic Characteristic

The areal saturation magnetization [Wb/m] of the high-frequency transmission line of each sample was determined according to measurement by a vibrating sample magnetometer (VSM). The areal saturation magnetization Ms of each sample is a physical property independent of the frequency F of the AC electric signal transmitted by the high-frequency transmission line. Table 2 lists Ms of each sample. However, Ms was less than a measurement limit ($5.7\times10^{-8}$) in Samples 8, 9, and 13. The VSM measured the total saturation magnetization [Wb·m]. Thus measured value was divided by the area S [$m^2$] of the meander pattern, so as to determine the areal saturation magnetization [Wb/m].

Measurement of AC Resistance

AC electric signals having frequencies F [GHz] at values listed in the following Table 2 were caused to flow through the high-frequency transmission lines of Samples 1 to 8, and 13, and the AC resistance Rs(F) [Ω] in each high-frequency transmission line at each frequency F [GHz] was measured by an impedance analyzer. The AC resistance Rs(F) is the resistance between one end part of the high-frequency transmission line (meander pattern) and the other end part thereof. By the same method, the AC resistance Rs−cu(F) [Ω] in the high-frequency transmission line of Sample 9 at each frequency F was measured. Then, the ratio r(F) of Rs(F) to Rs−cu(F) at each frequency F in each sample was determined. As represented by the following expression (A), r(F) depends on the frequency F. Within a region surrounded by a double line, the following Table 2 shows r(F) at each frequency F in each sample. The high-frequency transmission line (meander pattern) having smaller r(F) is more effective in inhibiting covering the conductor layer 6 with the coating layer 8 from increasing the AC resistance.

$$r(F)=Rs(F)/Rs-cu(F). \quad (A)$$

Figure 2:
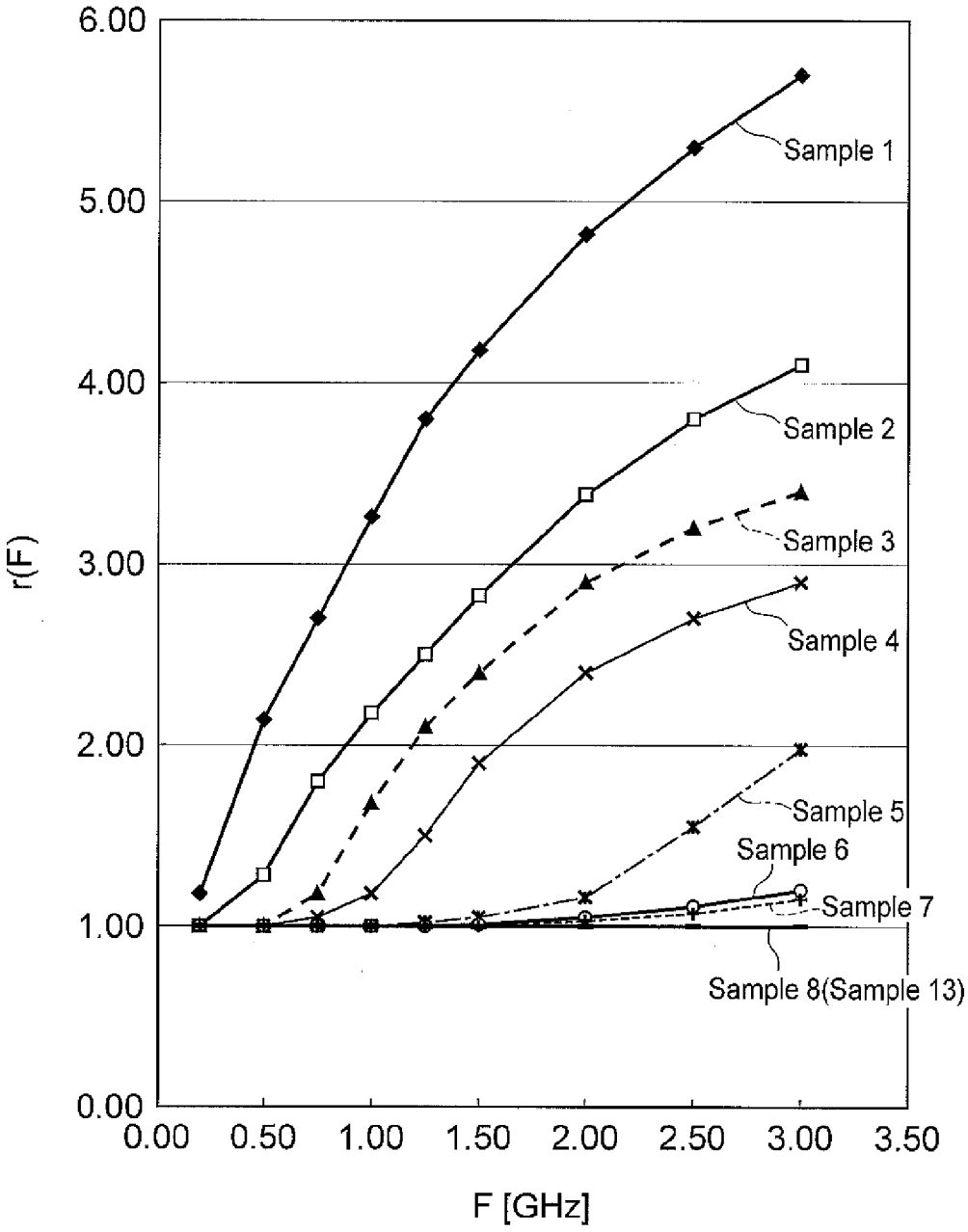
FIG. 2 is a graph illustrating a relationship between the frequency F of an AC electric signal transmitted by each high-frequency transmission line and r(F) thereof at each frequency F.
Figure 3:
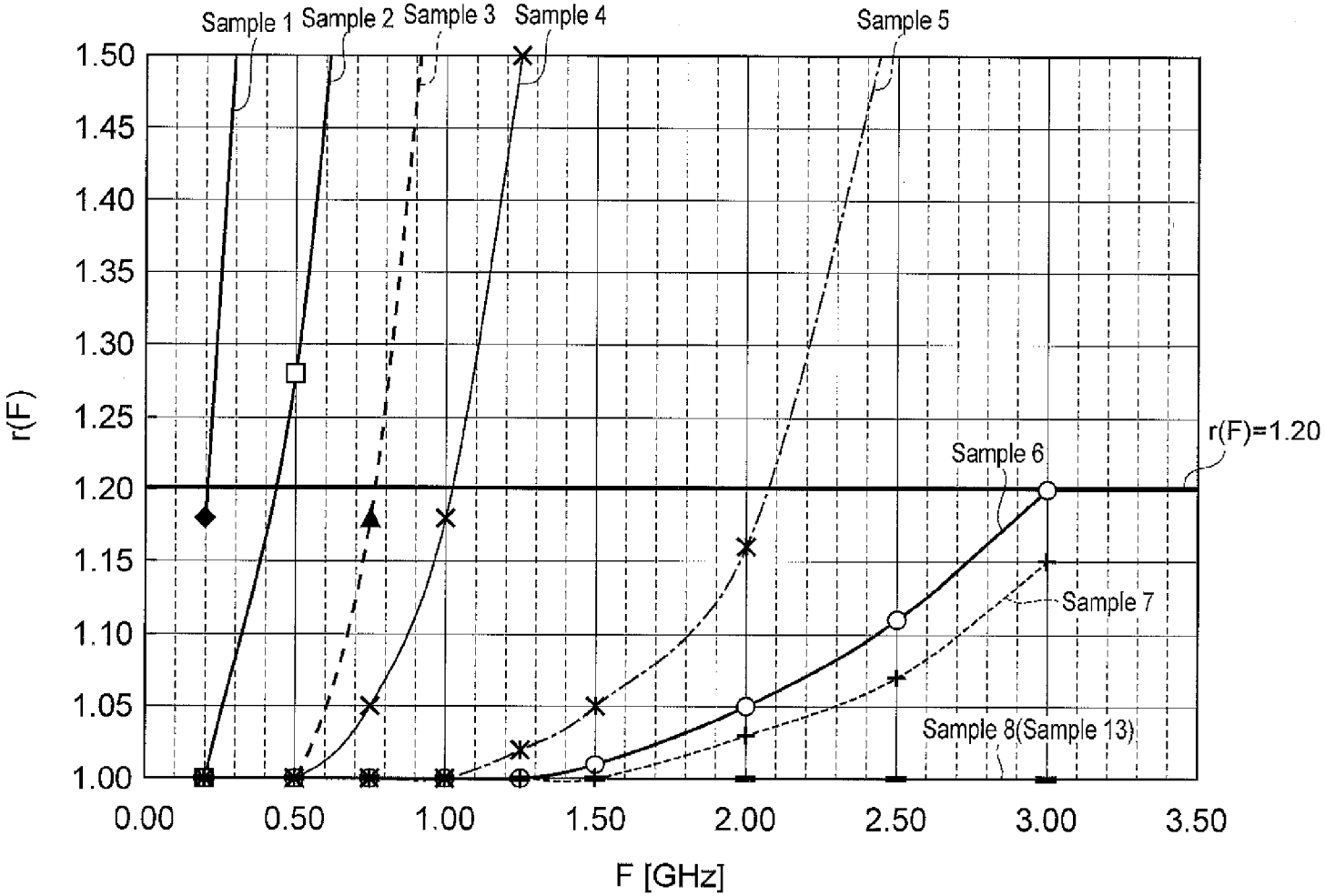
FIG. 3 is an enlarged view of FIG. 2.
Figure 4:
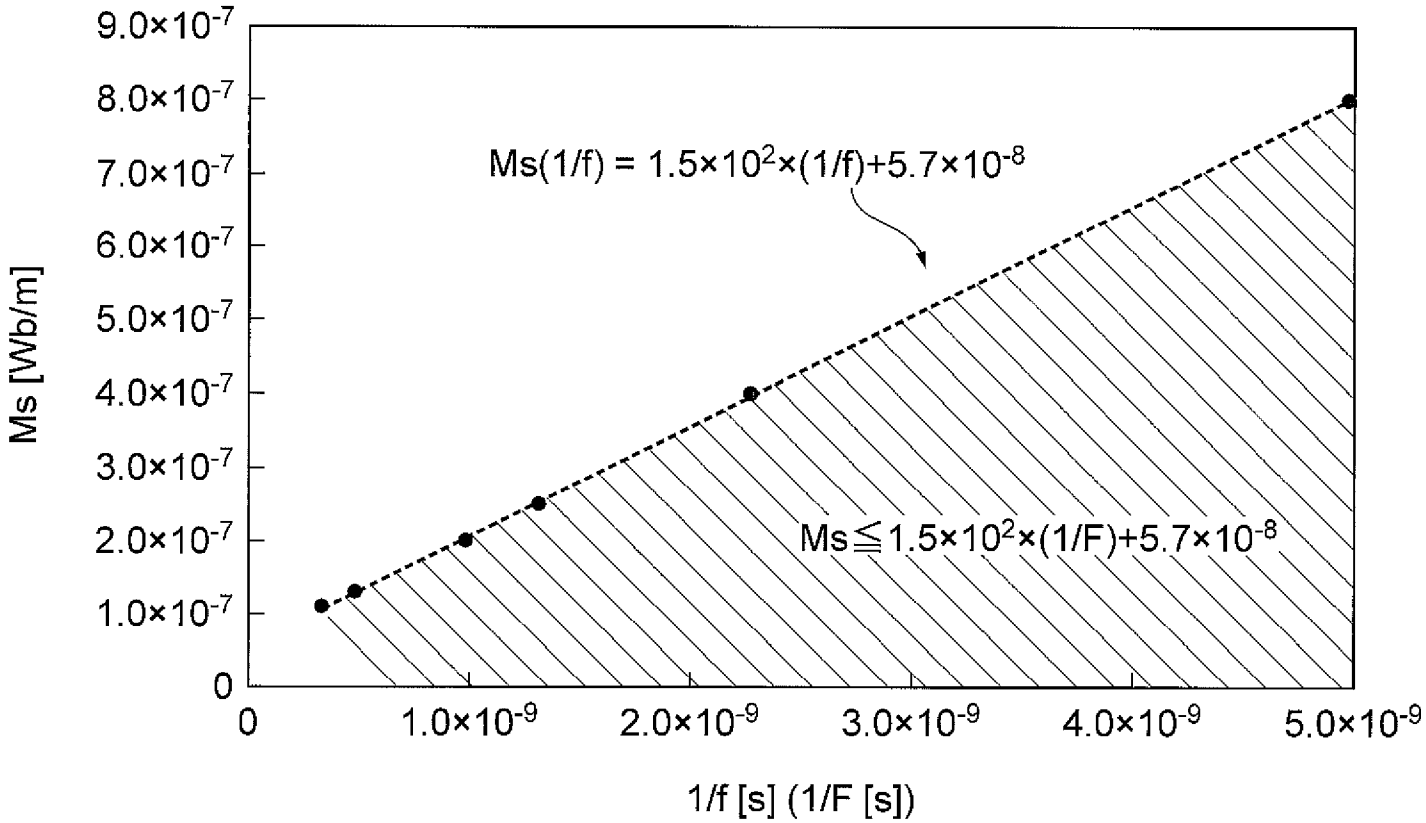
FIG. 4 is a chart illustrating the relationship between the areal saturation magnetization Ms of the high-frequency transmission line and a reciprocal (1/f) of the frequency of the AC electric signal when r(F) is 1.2.

By plotting each frequency F listed in Table 2 and r(F) of each sample at each frequency F, graphs illustrated in FIGS. 2 and 3 were drawn. FIG. 3 is an enlarged view of FIG. 2. Approximate lines illustrated in FIGS. 2 and 3 are those connecting points equivalent to F and r(F) in Table 2 and correspond to functions r(F). As illustrated in FIG. 2, r(F) of Sample 8 and r(F) of Sample 13 coincide with each other at each frequency F. Hence, the approximate line of Sample 8 and that of Sample 13 overlap with each other. As illustrated in FIG. 3, the frequency f [GHz] at an intersection between a line indicating r(F)=1.20 and the approximate line of each sample was determined. That is, the frequency f at the time when r(F) was 1.20 was determined in each sample. The value at 1.20 is a threshold for determining the degree of increase in AC resistance caused by covering the conductor layer with the coating layer (skin effect). The fact that r(F) is 1.20 or less means that the increase in AC resistance is suppressed sufficiently. As illustrated in FIG. 3, r(F) was less than 1.2 in each of Samples 7, 8, and 13 within the range where the frequency F was 3.00 GHz or less. Table 3 lists the frequency f and its reciprocal 1/f in each sample. The unit of f in each of the samples listed in Table 3 is Hz. By plotting actually measured Ms values of the samples and the reciprocal (1/f) of frequency of each sample listed in Table 3, a graph illustrated in FIG. 4 was drawn. The broken line illustrated in FIG. 4 is a linear approximate line obtained from a plurality of points corresponding to Ms and 1/f of the samples and represented by the following expression (B). That is, Ms is approximated as a function of 1/f. The unit of f in the following expression (B) is Hz.

$$Ms(1/f)=1.5\times10^{2}\times(1/f)+5.7\times10^{-8}. \quad (B)$$

The above-mentioned expression (B) is generalized as the following expression (C). That is, Ms is approximated as a function of F. By substituting the frequency F listed in Table 2 into the following expression (C), the calculated areal saturation magnetization value Ms(F) [Wb/m] corresponding to each frequency F was determined. Here, the unit of frequency F substituted into the following expression (C) is Hz. Table 2 lists Ms(F) corresponding to each frequency F.

$$Ms(F)=(1.5\times10^{2})/F+5.7\times10^{-8}. \quad (C)$$

In each of the following tables, the notation "E−0n" (where n is a given natural number) indicates "$\times10^{-n}$." The notation "E−10" indicates "$\times10^{-10}$." The notation "E+0n" indicates "$\times10^{n}$."

TABLE 3-continued

| Table 3 | Ms [Wb/m] | f [Hz] | 1/f [sec] |
|---|---|---|---|
| Sample5 | 1.3E−07 | 2.07E+09 | 4.82E−10 |
| Sample6 | 1.1E−07 | 3.00E+09 | 3.33E−10 |
| Sample7 | 1.0E−07 | f > 3.00E+09 | — |
| Sample8 | Ms < 5.7E−08 | f > 3.00E+09 | — |
| Sample13 | Ms < 5.7E−08 | f > 3.00E+09 | — |

It was seen from Table 2 that r(F) increased as the frequency rose in each of Samples 1 to 7 equipped with the electroless nickel plating layer. That is, the phenomenon of AC resistance increasing along with covering the conductor layer 6 with the coating layer 8 was seen to become more remarkable as the frequency F was higher.

It was seen from Table 2 that r(F) was 1.2 or less at any frequency F when the actually measured areal saturation magnetization value Ms of each sample was not greater than the calculated value Ms(F). It was also seen that r(F) was greater than 1.2 at any frequency F when the actually measured areal saturation magnetization value Ms of each sample was greater than the calculated value Ms(F). That is, all the values of r(F) marked with an asterisk in Table 2 were 1.2 or less, and all of the actually measured areal saturation magnetization values Ms and frequencies F of the samples corresponding to r(F) of 1.2 or less satisfy the following expression (1):

$$Ms\leq(1.5\times10^{2})/F+5.7\times10^{-8}. \quad (1)$$

TABLE 1

| Table 1 | Plating solution | | | | | | | Coating layer | |
|---|---|---|---|---|---|---|---|---|---|
| Sample | pH | Temperature | Ni source | Reductant | Complexing agent | | Stabilizer | Thickness | Phosphorus |
| 1 | 6.0 | 85° C. | 25 g/L | 20 g/L | carboxylic acid | hydroxy acid | bismuth compound | 2 μm | 2.1 mass % |
| 2 | 6.0 | 85° C. | 25 g/L | 20 g/L | carboxylic acid | hydroxy acid | bismuth compound | 1 μm | 2.1 mass % |
| 3 | 7.0 | 85° C. | 25 g/L | 40 g/L | hydroxy acid | | bismuth compound | 2 μm | 4.5 mass % |
| 4 | 4.5 | 85° C. | 25 g/L | 30 g/L | amino acid | dicarboxylic acid | bismuth compound | 3 μm | 6.6 mass % |
| 5 | 4.5 | 85° C. | 25 g/L | 30 g/L | amino acid | dicarboxylic acid | bismuth compound | 2 μm | 6.6 mass % |
| 6 | 4.5 | 85° C. | 15 g/L | 30 g/L | amino acid | dicarboxylic acid | bismuth compound | 2 μm | 8.3 mass % |
| 7 | 4.5 | 85° C. | 25 g/L | 30 g/L | amino acid | dicarboxyiic acid | sulfur compound | 2 μm | 9.9 mass % |

TABLE 2

| | | r(F) = Rs(F)/Rs − cu(F) F [GHz] | | | | | | | | |
|---|---|---|---|---|---|---|---|---|---|---|
| Table 2 | Ms(F) [Wb/m] | 0.20 8.1E−07 | 0.50 3.6E−07 | 0.75 2.6E−07 | 1.00 2.1E−07 | 1.25 1.8E−07 | 1.50 1.6E−07 | 2.00 1.3E−07 | 2.50 1.2E−07 | 3.00 1.1E−07 |
| Sample1 | Ms = 8.0E−07 | * 1.18 | 2.14 | 2.70 | 3.26 | 3.80 | 4.18 | 4.82 | 5.30 | 5.70 |
| Sample2 | Ms = 4.0E−07 | * 1.00 | 1.28 | 1.80 | 2.18 | 2.50 | 2.83 | 3.38 | 3.80 | 4.10 |
| Sample3 | Ms = 2.5E−07 | * 1.00 | * 1.00 | * 1.18 | 1.68 | 2.10 | 2.40 | 2.90 | 3.20 | 3.40 |
| Sample4 | Ms = 2.0E−07 | * 1.00 | * 1.00 | * 1.05 | * 1.18 | 1.50 | 1.90 | 2.40 | 2.70 | 2.90 |
| Sample5 | Ms = 1.3E−07 | * 1.00 | * 1.00 | * 1.00 | * 1.00 | * 1.02 | * 1.05 | * 1.16 | 1.55 | 1.98 |
| Sample6 | Ms = 1.1E−07 | * 1.00 | * 1.00 | * 1.00 | * 1.00 | * 1.00 | * 1.01 | * 1.05 | * 1.11 | * 1.20 |
| Sample7 | Ms = 1.0E−07 | * 1.00 | * 1.00 | * 1.00 | * 1.00 | * 1.00 | * 1.00 | * 1.03 | * 1.07 | * 1.15 |
| Sample8 | Ms < 5.7E−08 | * 1.00 | * 1.00 | * 1.00 | * 1.00 | * 1.00 | * 1.00 | * 1.00 | * 1.00 | * 1.00 |
| Sample9 | Ms < 5.7E−08 | (1.00) | (1.00) | (1.00) | (1.00) | (1.00) | (1.00) | (1.00) | (1.00) | (1.00) |
| Sample13 | Ms < 5.7E−08 | * 1.00 | * 1.00 | * 1.00 | * 1.00 | * 1.00 | * 1.00 | * 1.00 | * 1.00 | * 1.00 |

TABLE 3

| Table 3 | Ms [Wb/m] | f [Hz] | 1/f [sec] |
|---|---|---|---|
| Sample1 | 8.0E−07 | 2.01E+08 | 4.98E−09 |
| Sample2 | 4.0E−07 | 4.40E+08 | 2.27E−09 |
| Sample3 | 2.5E−07 | 7.61E+08 | 1.31E−09 |
| Sample4 | 2.0E−07 | 1.02E+09 | 9.84E−10 |

As in the foregoing, it was seen that covering the conductor layer 6 with the coating layer 8 was more inhibited from increasing the AC resistance when the above-mentioned expression (1) held between the frequency F and the actually measured areal saturation magnetization of each sample than when not.

Relationship Between Surface Roughness of Glass Epoxy Substrate and AC Resistance Sample 10

Sample 10 was made by the same method as with Sample 1 except that a glass epoxy substrate with a surface having an arithmetic mean roughness Ra of 0.2 μm and a ten-point mean roughness Rz of 1.3 μm was used. The measured value of Ms in Sample 10 was $8.0\times10^{-7}$ as in Sample 1.

Sample 11

Sample 11 was made by the same method as with Sample 7 except that a glass epoxy substrate with a surface having an arithmetic mean roughness Ra of 0.2 μm and a ten-point mean roughness Rz of 1.3 μm was used. The measured value of Ms in Sample 11 was $1.0\times10^{-7}$ as in Sample 7.

Sample 12

Sample 12 (a meander pattern made of Cu) was made by the same method as with Sample 9 except that a glass epoxy substrate with a surface having an arithmetic mean roughness Ra of 0.2 μm and a ten-point mean roughness Rz of 1.3 μm was used. The measured value of Ms in Sample 12 was less than the measurement limit ($5.7\times10^{-8}$) as in Sample 9.

Figure 5:
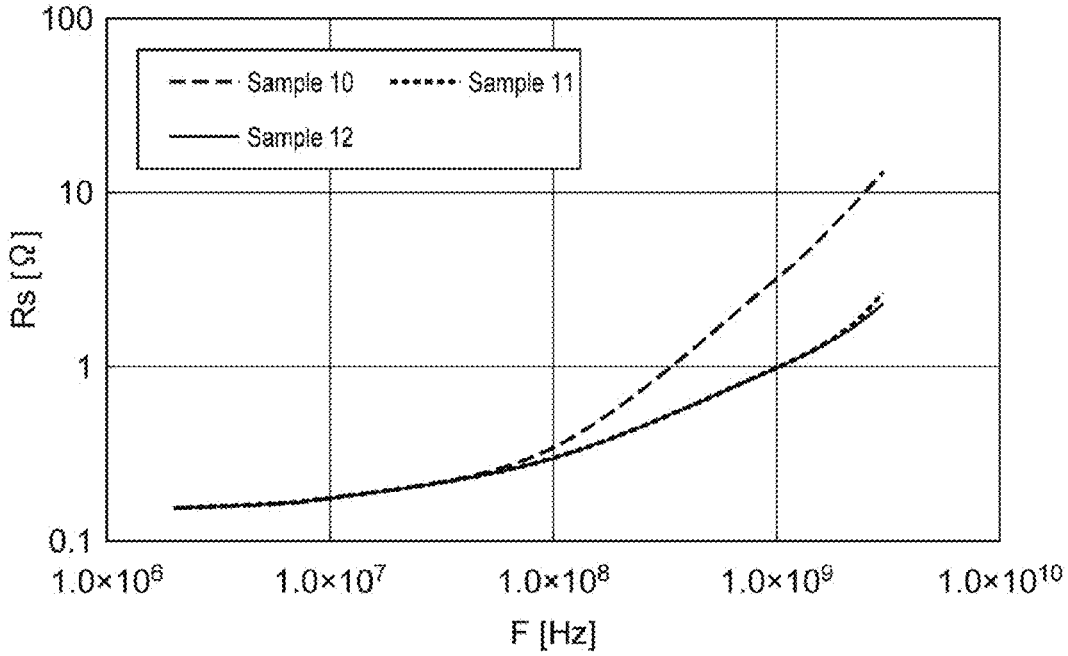
Figure 5:
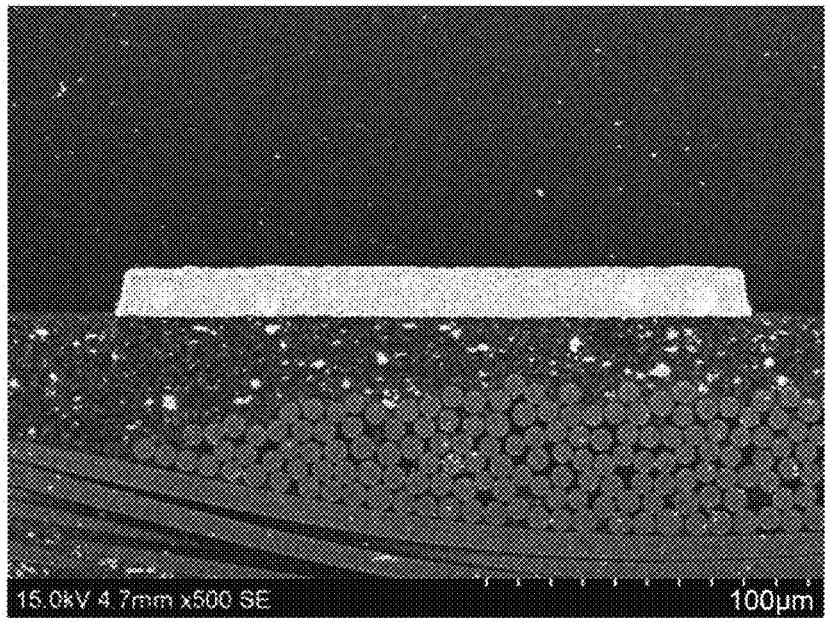

While sweeping the frequency F of the AC electric signal flowing through Sample 10 within a range from 100 MHz to 3.0 GHz, the AC resistance Rs [Ω] of Sample 10 at each frequency F [GHz] was measured by an impedance analyzer. Samples 11 and 12 were also measured in the same manner. FIG. 5*a* illustrates the respective values of AC resistance in Samples 10, 11, and 12 at each frequency F. The ordinate and abscissa of FIG. 5*a* are provided with logarithmic scales. FIG. 5*b* illustrates a photograph of a cross section of Sample 11 perpendicular to a surface of the glass epoxy substrate. The photograph was taken by a scanning electron microscope.

Figure 6:
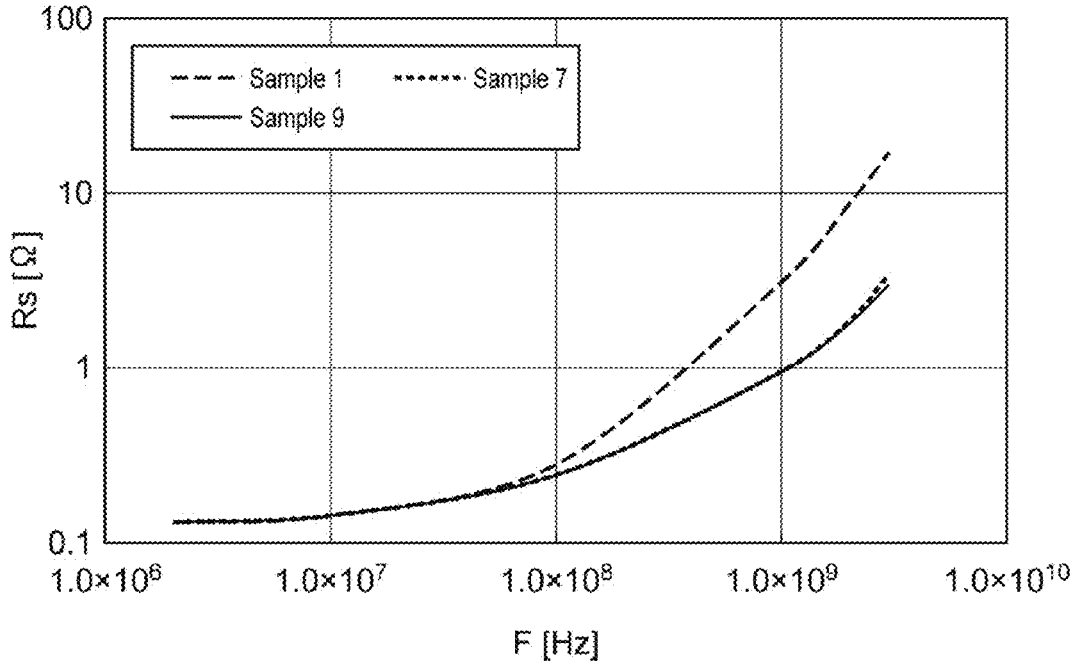
Figure 6:
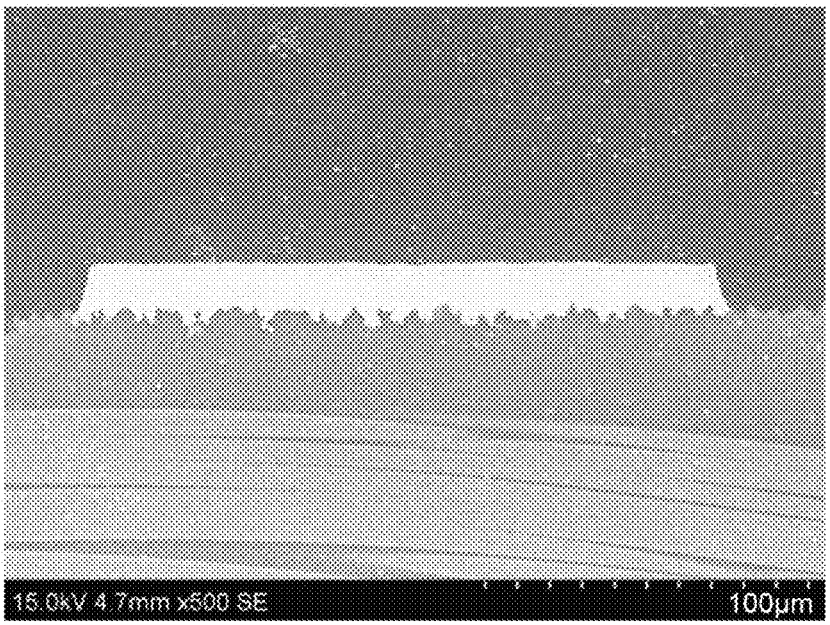

FIG. 6*a* illustrates the respective values of AC resistance Rs in Samples 1, 7, and 9 at each frequency F as measured by the same method as with Sample 10. The ordinate and abscissa of FIG. 6*a* are provided with logarithmic scales. FIG. 6*b* illustrates a photograph of a cross section of Sample 7 perpendicular to a surface of the glass epoxy substrate. The photograph was taken by a scanning electron microscope.

When comparing Samples 10 and 12 with each other according to FIG. 5*a*, the AC resistance of Sample 10 having the higher saturation magnetization was seen to increase drastically as the frequency F rose in a region where the frequency F was about 100 MHz or higher. That is, covering the conductor layer with the coating layer having higher magnetism was seen to make the increase in AC resistance (skin effect) remarkable when the frequency F was about 100 MHz or higher.

As illustrated in FIG. 6*a*, the AC resistance in Sample 1 having the higher saturation magnetization was seen to increase more drastically than in Sample 9 as the frequency F rose in a region where the frequency F was about 100 MHz or higher. That is, covering the conductor layer with the coating layer having higher magnetism was seen to make the increase in AC resistance (skin effect) remarkable when the frequency F was about 100 MHz or higher. However, by satisfying the above-mentioned expression (1), Samples 7 and 11 can inhibit the AC resistance from increasing as mentioned above.

When FIGS. 5*a* and 6*a* were compared with each other, it was seen difficult to sufficiently suppress the increase in AC resistance (skin effect) in a high frequency band of 100 MHz or above by simply reducing the surface roughness of the glass epoxy substrate.

Sample 1*a*

A step of forming a conductor layer of Sample 1*a* formed a meander pattern (conductor layer 6) made of copper and a feed terminal connected to one end part thereof along a surface of a glass epoxy substrate (insulating support 4). A high-frequency transmission line 2 of Sample 1*a* was made by using the same method and materials as with Sample 1 except for the step of forming the conductor layer 6. The high-frequency transmission line 2 of Sample 1*a* has the same structure and composition as with Sample 1 except that the feed terminal is connected to only one end part thereof. A high-frequency feed circuit was electrically connected to the feed terminal connected to the high-frequency transmission line of Sample 1*a* and grounded, so as to make an antenna device of Sample 1*a*.

Figure 7:
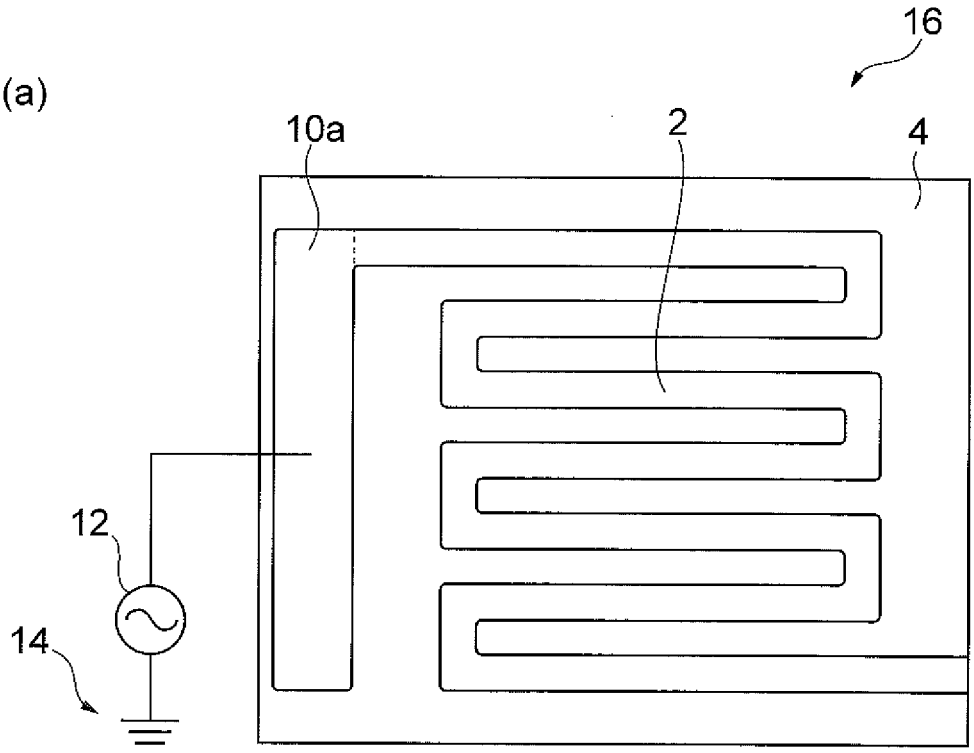
Figure 7:
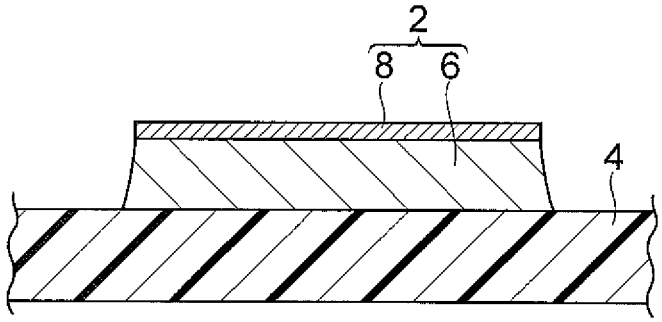

Hence, as illustrated in FIG. 7(*a*), the antenna device 16 of Sample 1*a* comprises the glass epoxy substrate (insulating support 4), the high-frequency transmission line 2 (antenna) disposed along the surface of the glass epoxy substrate, a feed terminal 10*a* disposed on the surface of the glass epoxy substrate, and a high-frequency feed circuit 12. The feed terminal 10*a* is electrically connected to one end part of the high-frequency transmission line 2. The high-frequency feed circuit 12 is electrically connected to the feed terminal 10*a*. The high-frequency feed circuit 12 is grounded. As illustrated in FIG. 7(*b*), the high-frequency transmission line 2 in the antenna device 16 has the conductor layer 6 made of copper disposed on the surface of the glass epoxy substrate (insulating support 4) and an electroless nickel plating layer (coating layer 8) covering the conductor layer 6.

Sample 4*a*

A step of forming a conductor layer 6 of Sample 4*a* formed a meander pattern (conductor layer 6) made of copper and a feed terminal connected to one end part thereof along a surface of a glass epoxy substrate (insulating support 4). A high-frequency transmission line 2 of Sample 4*a* was made by using the same method and materials as with Sample 4 except for the step of forming the conductor layer 6. The high-frequency transmission line 2 of Sample 4*a* has the same structure and composition as with Sample 4 except that the feed terminal 10*a* is connected to only one end part thereof. A high-frequency feed circuit 12 was electrically connected to the feed terminal 10*a* connected to the high-frequency transmission line 2 of Sample 4*a* and grounded, so as to make an antenna device 16 of Sample 4*a*.

Sample 5*a*

A step of forming a conductor layer 6 of Sample 5*a* formed a meander pattern (conductor layer 6) made of copper and a feed terminal connected to one end part thereof along a surface of a glass epoxy substrate (insulating support 4). A high-frequency transmission line 2 of Sample 5*a* was made by using the same method and materials as with Sample 5 except for the step of forming the conductor layer 6. The high-frequency transmission line 2 of Sample 5*a* has the same structure and composition as with Sample 5 except that the feed terminal 10*a* is connected to only one end part thereof. A high-frequency feed circuit 12 was electrically connected to the feed terminal 10*a* connected to the high-frequency transmission line 2 of Sample 5*a* and grounded, so as to make an antenna device 16 of Sample 5*a*.

Sample 7*a*

A step of forming a conductor layer 6 of Sample 7*a* formed a meander pattern (conductor layer 6) made of copper and a feed terminal connected to one end part thereof along a surface of a glass epoxy substrate (insulating support 4). A high-frequency transmission line 2 of Sample 7*a* was made by using the same method and materials as with Sample 7 except for the step of forming the conductor layer 6. The high-frequency transmission line 2 of Sample 7*a* has the same structure and composition as with Sample 7 except that the feed terminal 10*a* is connected to only one end part thereof. A high-frequency feed circuit 12 was electrically connected to the feed terminal 10*a* connected to the high-frequency transmission line 2 of Sample 7*a* and grounded, so as to make an antenna device 16 of Sample 7*a*.

Sample 9*a*

A step of forming a conductor layer 6 of Sample 9*a* formed a meander pattern (conductor layer 6) made of copper and a feed terminal connected to one end part thereof along a surface of a glass epoxy substrate (insulating support 4). A high-frequency transmission line of Sample 9*a* was made by using the same method and materials as with Sample 9 except for the step of forming the conductor layer 6. The high-frequency transmission line of Sample 9*a* has the same structure and composition as with Sample 9 except that the feed terminal 10*a* is connected to only one end part thereof. A high-frequency feed circuit 12 was electrically connected to the feed terminal 10*a* connected to the high-frequency transmission line of Sample 9*a* and grounded, so as to make an antenna device of Sample 9*a*.

Sample 13*a*

A step of forming a conductor layer 6 of Sample 13*a* formed a meander pattern (conductor layer 6) made of copper and a feed terminal connected to one end part thereof along a surface of a glass epoxy substrate (insulating support 4). A high-frequency transmission line 2 of Sample 13*a* was made by using the same method and materials as with Sample 13 except for the step of forming the conductor layer 6. The high-frequency transmission line 2 of Sample 13*a* has the same structure and composition as with Sample 13 except that the feed terminal 10*a* is connected to only one end part thereof. A high-frequency feed circuit 12 was electrically connected to the feed terminal 10*a* connected to the high-frequency transmission line 2 of Sample 13*a* and grounded, so as to make an antenna device 16 of Sample 13*a*.

Evaluation of Magnetic Characteristic

The areal saturation magnetization Ms [Wb/m] of the high-frequency transmission line 2 in each of the antenna devices 16 (Samples 1*a*, 4*a*, 5*a*, 7*a*, and 13*a*) was determined by the same method as with Sample 1. Table 4 lists the results. By substituting the frequencies F listed in Table 4 into the above-mentioned expression (C), calculated areal saturation magnetization values Ms(F) [Wb/m] corresponding to the respective frequencies F were determined. Table 4 lists Ms(F) corresponding to each frequency F.

Evaluation of Characteristics of Antenna Device

Using each of the antenna devices 16 (Samples 1*a*, 4*a*, 5*a*, 7*a*, and 13*a*) as a transmitter, the electric power received by a known receiver was measured in an anechoic chamber. According to the measurement, the radiation efficiency Gs(F) [dB] of each antenna device 16 at each frequency F listed in Table 4 was determined. By the same method, the radiation efficiency Gs−cu(F) [dB] of the antenna device of Sample 9*a* at each frequency F was determined. Then, according to the following expression (D), the difference g(F) [dB] of G(F) of each antenna device 16 from GS−cu(F) at each frequency F was determined. Within a region surrounded by a double line, the following Table 4 shows g(F) at each frequency F in each antenna device 16. As represented by the following expression (D), g(F) depends on the frequency F. The radiation efficiency becomes higher as g(F) is greater.

$$g(F)=Gs(F)-Gs-cu(F). \quad (D)$$

TABLE 4

Table 4

| | | g(F) [dB] = Gs(F) − Gs-cu(F) F [GHz] | | | |
|---|---|---|---|---|---|
| | | 0.75 | 1.25 | 2.00 | 3.00 |
| | | Ms(F) [Wb/m] | | | |
| | | 2.6E−07 | 1.8E−07 | 1.3E−07 | 1.1E−07 |
| Sample 1 | Ms = 8.0E−07 | −0.6 | −0.9 | −1.0 | −1.1 |
| Sample 4 | Ms = 2.0E−07 | *0.0 | −0.3 | −0.6 | −0.7 |
| Sample 5 | Ms = 1.3E−07 | *0.0 | *0.0 | *−0.1 | −0.4 |
| Sample 7 | Ms = 1.0E−07 | *0.0 | *0.0 | *0.0 | *−0.1 |
| Sample 13 | Ms < 5.7E−08 | *0.0 | *0.0 | *0.0 | *0.0 |

It was seen from Table 4 that, when the actually measured areal saturation magnetization value Ms of the high-frequency transmission line 2 in each antenna device 16 was the calculated value Ms(F) or less, g(F) was −0.1 dB or greater at each frequency F, whereby each antenna device 16 had high radiation efficiency. In other words, the difference between the radiation efficiency Gs(F) of each antenna device 16 equipped with the coating layer 8 and the radiation efficiency Gs−cu(F) of the antenna device (Sample 9*a*) without the coating layer 8 was seen to be very small at each frequency F when the actually measured areal saturation magnetization value Ms of the high-frequency transmission line in each antenna device 16 was the calculated value Ms(F) or less. It was also seen that, when the actually measured areal saturation magnetization value Ms of the high-frequency transmission line 2 in each antenna device 16 was greater than the calculated value Ms(F), g(F) was −0.3 dB or less at each frequency F, whereby each antenna device 16 had low radiation efficiency. In other words, a significant difference was seen to exist between the radiation efficiency Gs(F) of each antenna device 16 equipped with the coating layer 8 and the radiation efficiency Gs−cu(F) of the antenna device (Sample 9*a*) without the coating layer 8 at each frequency F when the actually measured areal saturation magnetization value Ms of the high-frequency transmission line 2 in each antenna device 16 was greater than the calculated value Ms(F). That is, all the values of g(F) marked with an asterisk in Table 4 are −0.1 dB or less, and all of the actually measured areal saturation magnetization values Ms and frequencies F of the samples corresponding to g(F) of −0.1 dB or less satisfy the following expression (1):

$$Ms \leq (1.5\times10^{2})/F+5.7\times10^{-8}. \quad (1)$$

As in the foregoing, it was seen that covering the conductor layer 6 with the coating layer 8 was more inhibited from lowering the radiation efficiency when the above-mentioned expression (1) held between the frequency F and the actually measured areal saturation magnetization value Ms of the high-frequency transmission line 2 in each antenna device 16 than when not.

INDUSTRIAL APPLICABILITY

The present invention provides a high-frequency transmission line having low AC resistance and an antenna (radiation and absorption conductors) and an electronic circuit which are equipped with the high-frequency transmission line. By using the above-mentioned expression (1), the present invention can select a plating type or plating thickness suitable for achieving low AC resistance for a required frequency. Hence, the present invention is expected to be effective in improving the reliability and performances of electronic components used in high-frequency bands, cutting down their costs, and so forth.

REFERENCE SIGNS LIST

2 . . . high-frequency transmission line; 4 . . . insulating support; 6 . . . conductor layer; 8 . . . coating layer; 10 . . . terminal (measurement terminal); 10*a* . . . feed terminal; 12 . . . high-frequency feed circuit; 14 . . . ground (earth); 16 . . . antenna device

What is claimed is:

1. A high-frequency transmission line disposed along a surface of an insulating support;

wherein, letting F [Hz] be the frequency of an alternate current electric signal transmitted by the high-frequency transmission line, and Ms [Wb/m] be the saturation magnetization per unit area of the high-frequency transmission line, the frequency value F and the saturation magnification value per unit area Ms satisfy the following expression (1):

$$Ms \leq (1.5\times10^{2})/F+5.7\times10^{-8} \quad (1).$$

2. A high-frequency transmission line according to claim 1, comprising:

a conductor layer disposed on the surface of the insulating support; and a coating layer covering a surface of the conductor layer.

3. A high-frequency transmission line according to claim 2, wherein the coating layer contains at least one of nickel and palladium.

4. A high-frequency transmission line according to claim 3, wherein the coating layer contains nickel;

wherein the coating layer is formed by electroless plating; and wherein a plating solution used for the electroless plating contains at least one complexing agent selected from the group consisting of carboxylic acids, dicarboxylic acids, hydroxy acids, and amino acids and elemental nickel.

5. A high-frequency transmission line according to claim 3, wherein the coating layer contains elemental phosphorus.

6. A high-frequency transmission line according to claim 4, wherein the plating solution contains phosphorus.

7. An antenna comprising the high-frequency transmission line according to one of claim 1.

8. An antenna comprising the high-frequency transmission line according to one of claim 2.

9. An antenna comprising the high-frequency transmission line according to one of claim 3.

10. An antenna comprising the high-frequency transmission line according to one of claim 5.

11. An electronic circuit board comprising the high-frequency transmission line according to one of claim 1.

12. An electronic circuit board comprising the high-frequency transmission line according to one of claim 2.

13. An electronic circuit board comprising the high-frequency transmission line according to one of claim 3.

14. An electronic circuit board comprising the high-frequency transmission line according to one of claim 5.

* * * * *